US006397539B1

(12) United States Patent
Kimura

(10) Patent No.: US 6,397,539 B1
(45) Date of Patent: Jun. 4, 2002

(54) FLOORING FOR A BUILDING

(75) Inventor: Motoyasu Kimura, Tokyo (JP)

(73) Assignee: Kimura Corporation, Tokyo (JP)

( * ) Notice: Subject to any disclaimer, the term of this patent is extended or adjusted under 35 U.S.C. 154(b) by 0 days.

(21) Appl. No.: 09/634,636

(22) Filed: Aug. 8, 2000

(30) Foreign Application Priority Data

Aug. 9, 1999 (JP) ..... 11-225802
Nov. 25, 1999 (JP) ..... 11-335000

(51) Int. Cl.[7] ..... E04B 1/70
(52) U.S. Cl. ..... 52/302.4; 52/302.1; 52/126.6
(58) Field of Search ..... 52/302.4, 302.2, 52/302.1, 126.5, 126.6, 263; 119/450

(56) References Cited

U.S. PATENT DOCUMENTS 4,231,325 A * 11/1980 Parks ..... 119/28
4,637,181 A * 1/1987 Cohen ..... 52/126.5
4,656,795 A * 4/1987 Albrecht et al. ..... 52/126.6
5,724,916 A * 3/1998 Brodie et al. ..... 119/525
5,732,658 A * 3/1998 Wolters et al. ..... 119/450
5,904,015 A * 5/1999 Chen ..... 52/263 X

* cited by examiner

*Primary Examiner*—David M. Purol
(74) *Attorney, Agent, or Firm*—Argent Fox Kintner Plotkin & Kahn, PLLC

(57) ABSTRACT

To provide flooring for a building, more specifically, flooring washable at its installation place in a building. In the flooring for a building which has a plurality of floor panels laid in parallel to constitute a whole floor, an opening is formed on a floor surface between one floor panel and its adjacent floor panel. The flooring for a building according to the present invention is provided with a gutter portion that is arranged below the opening to receive a liquid dripping from the opening. The gutter portion is formed as an integral part of the one floor panel, and communicates with a drain pipe for draining the liquid in the gutter portion to the outside. The present invention thus provides washable flooring for a building which is easy to construct.

4 Claims, 9 Drawing Sheets

FLOORING FOR A BUILDING

BACKGROUND OF THE INVENTION

1. Field of the Invention

The present invention relates to flooring for a building, and more specifically to flooring washable at its installation place in a building.

2. Description of the Related Art

Flooring for a building which requires water washing is formed, in most cases, through a series of steps: applying leveling mortar to a concrete floor slab, coating it with asphalt, forming a presser mortar layer, forming a cinder concrete layer, applying mortar as tile bedding, and finishing with tiles. The flooring formed through such steps is excellent in its water-proofness. On the other hand, it requires a quite long time in forming, which gives a major factor in prolonging construction period. Moreover, an enormous cost is required to repair the flooring even if it is partial damage.

Then, the inventors of the present invention have proposed a flooring structure capable of solving the problem described above.

The invention concerned is, as disclosed in Japanese Patent Publication No. 2539709, a flooring structure in which floor panels are arranged above a floor slab surface to effectively drain the water sprinkled on the floor panels.

To be specific, a joint member is placed between every adjacent floor panels out of a plurality of floor panels set on a plane, and joist members are arranged to support the right and left edges of the respective floor panels. Sleeper members for supporting the joist members are further arranged perpendicular to the joist members, and water communication holes are provided to communicate the joist members and the sleeper members.

One water communication hole consists of a hole formed in one joist member and a hole formed in the associated sleeper member which coincide with each other. Each joist member has a flange to prevent waste water from leaking outside.

A drain pipe for draining water flown therein from between the floor panel and the joint member is provided on an end of each sleeper member.

Strut members for supporting the sleeper member are arranged on the bottom surfaces of both ends of each sleeper member, and are grounded on the floor slab surface of the building so that the entire members are held.

A cylindrical ventilation body is connected to each sleeper member so that no smell stays in a space above the flooring as well as the interior of the sleeper member and the joist member is dried.

The structure described above makes it possible to assemble, with a simple construction, flooring capable of effectively drain washing water on the floor, where the water used to wash the flooring flows through the joist member to the sleeper member and is drained from the drain pipe to the outside.

As a result of extensive investigation, the inventors of the present invention have found that the flooring described above still has room to improve, i.e., that the thickness of the flooring should be thinned further as a whole and that the workability should be improved even more.

SUMMARY OF THE INVENTION

The present invention has been made in view of the above, and an object of the present invention is therefore to provide washable flooring for a building which can readily be constructed with a simple work.

The gist of the present invention is as follows.

According to the present invention, in flooring for a building which has a plurality of floor panels laid in parallel to constitute a whole floor, an opening is formed on a floor surface between one floor panel and its adjacent floor panel. The flooring for a building according to the present invention is provided with a gutter portion that is arranged below the opening to receive a liquid dripping from the opening. The gutter portion is formed as an integral part of the one floor panel, and communicates with a drain pipe for draining the liquid in the gutter portion to the outside.

Each of the floor panels has the gutter portion on one side and, on the other side, a connecting portion for connecting the gutter portion of another floor panel. The floor panels having the same shape are arranged such that the gutter portion of one floor panel is connected to the connecting portion of another floor panel, whereby the plural floor panels paralleled in the lateral direction may constitute the whole floor.

Alternatively, each of the floor panels may be formed into a rectangular shape in plane, and a plurality of sleeper members each having a flow path open to above and supporting the floor panel may be provided beneath the whole floor.

Each of the sleeper members is substantially perpendicular to the gutter portion at a vertical position below the gutter portion, and the gutter portion communicates with the flow path of the sleeper member to flow the liquid in the gutter portion into flow path.

A second opening may be formed on a floor surface between one floor panel and its longitudinally-adjacent floor panel, and one sleeper member may be arranged under this second opening, so that the flow path in the sleeper member directly receives a liquid dripping from the second opening. Note that longitudinally-adjacent floor panels means floor panels adjacent to each other in the direction coaxial with the gutter portion.

Also may be provided between every adjacent floor panels is a catch basin portion that is on the same plane as the surface of the floor panels.

The catch basin portion can take any structure as long as it is capable of bearing the weight of people who step on it and of passing a liquid such as washing water from the surface to the underneath. For example, it may be a catch basin portion having a lot of slits perforated to communicate spaces above and under the floor, or may be a mesh-like catch basin portion. Alternatively, the catch basin portion may be formed of a water-penetrative material.

According to the present invention, it is possible to obtain washable flooring for a building which can readily be constructed with a simple work.

It is also possible to obtain washable flooring for a building whose thickness can be thinned as a whole.

It is also possible to obtain washable flooring for a building which has excellent drain efficiency.

It is also possible to obtain washable flooring for a building whose components are easy to mold.

DETAILED DESCRIPTION OF THE PREFERRED EMBODIMENTS

Flooring for a building according to the present invention will be detailed further below with reference to FIGS. 1 to 11.

In the flooring for a building of this embodiment, a plurality of floor panels 2 are laid in parallel to form a whole floor.

Figure 5:
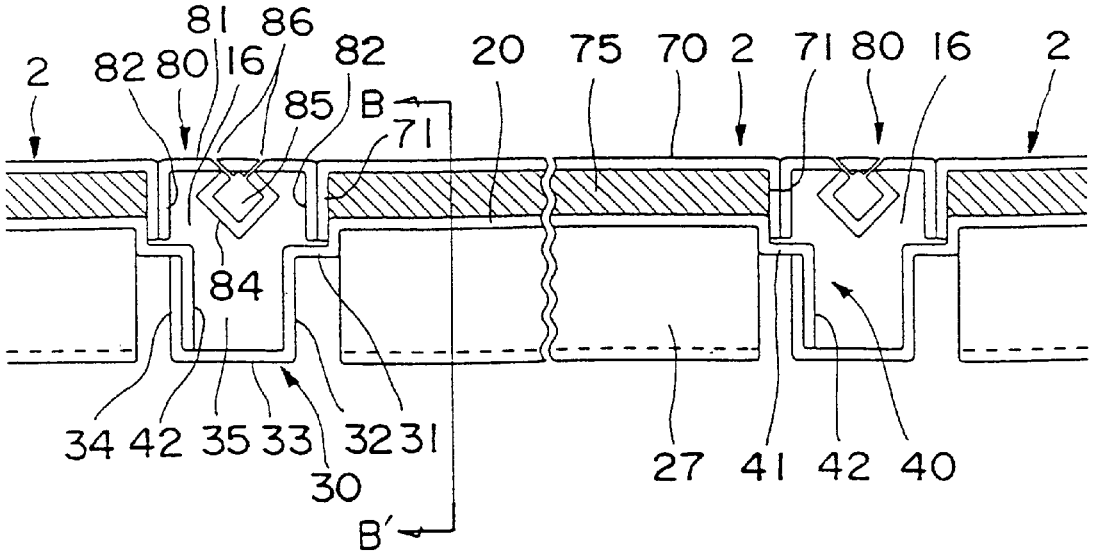
FIG. 5 is a sectional view in which the floor panel cut along the line A–A' in FIG. 1 is connected to its adjacent floor panel.

As shown in FIGS. 1 to 4, each of the floor panels 2 is comprised of: a panel body that is rectangular in plane; a concave gutter portion 30 formed on one of longer sides of the panel body (a first side); and a connecting portion 40 that is formed on the other longer side of the panel body (a second side) and has a shape corresponding to the shape of the external edge of the gutter portion 30. The gutter portion 30 and the connecting portion 40 are, as shown in FIG. 5, integrated with a main body portion 20 that constitutes a core material of the respective floor panels 2.

The gutter portion 30 is composed of: a first stepped portion 31 extending downward from the edge of one longer side of the main body portion 20; an inner side wall 32 hanging from the first stepped portion 31; a bottom portion 33 continued from the inner side portion 32; and an outer side wall 34 rising from the outer edge of the bottom portion 33.

The connecting portion 40 is composed of a second stepped portion 41 extending downward from the edge of the other longer side of the main body portion 20, and a connecting side wall 42 hanging from the second stepped portion 41.

On the other hand, both of the shorter sides of the respective floor panels 2 (a third side and a fourth side) have the same configuration. The shorter sides are each composed of: a third stepped portion 21 extending downward from the edge of one shorter side of the respective floor panels 2; a first slant portion 23 inclined outward and downward from the third stepped portion 21, a side wall 22 hanging from the first slant portion 23; a second slant portion 24 inclined upward from a lower part of the side wall 22 to the inside of the respective floor panels 2; and a hook portion 25 hanging from the edge of the second slant portion 24.

The first stepped portion 31, the second stepped portion 41, and the third stepped portions 21, 21 are all formed at the same vertical position.

Figure 1:
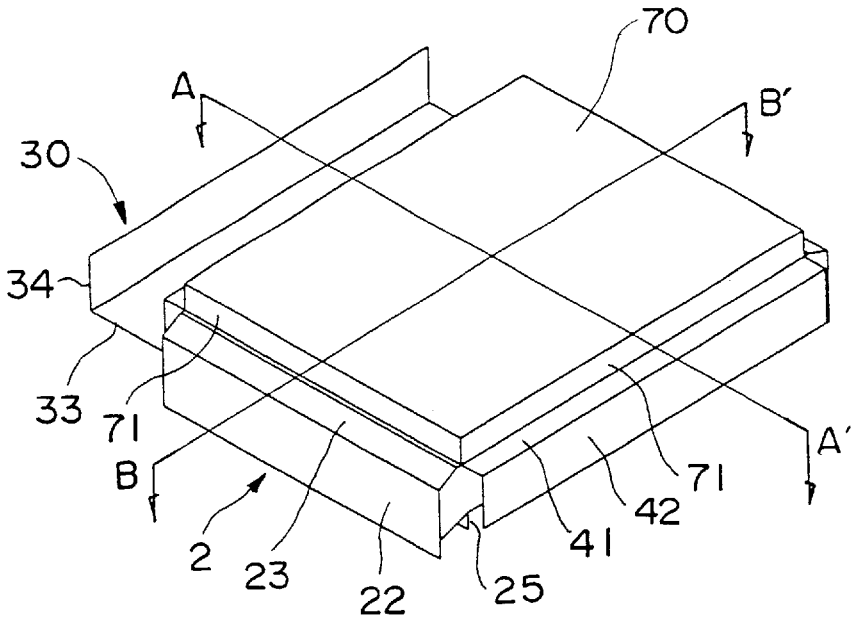
FIG. 1 is a perspective view showing a single floor panel of flooring for a building according to one embodiment of the present invention.
Figure 2:
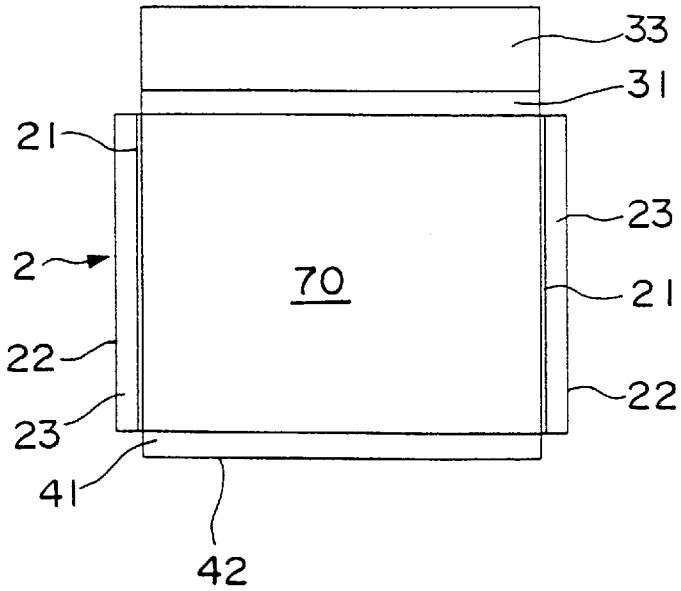
FIG. 2 is, a plan view showing the single floor panel according to the embodiment.
Figure 3:
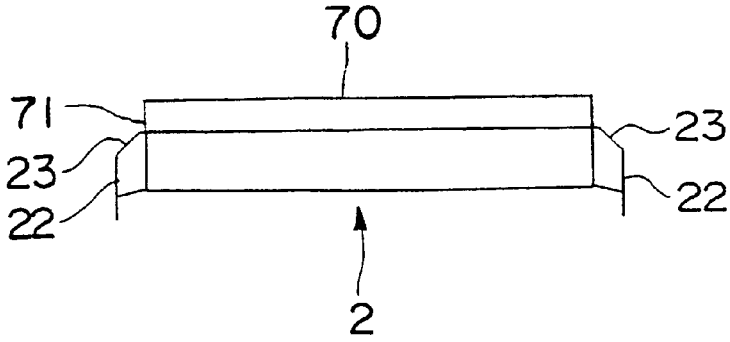
FIG. 3 is a frontal view showing the single floor panel according to the embodiment.
Figure 4:
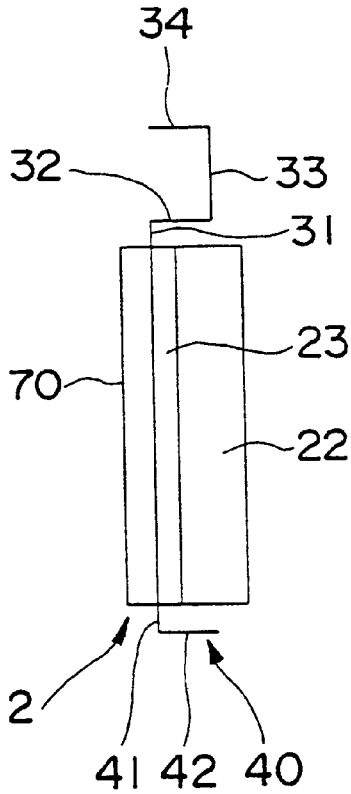
FIG. 4 is a side elevational view showing the single floor panel according to the embodiment.
Figure 6:
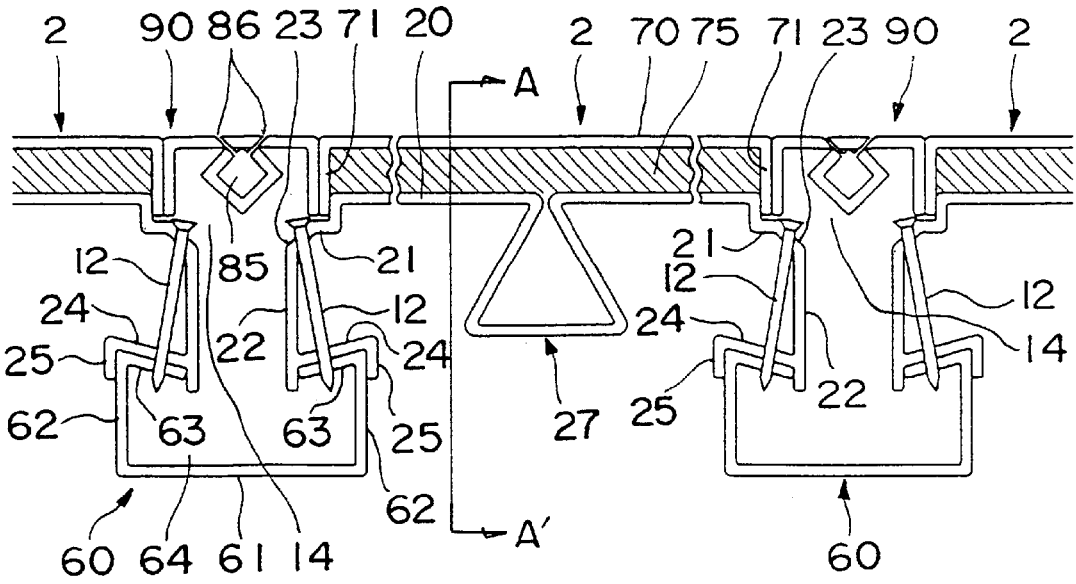
FIG. 6 is a sectional view showing the floor panel cut along the line B–B' in FIG. 1 is placed on a sleeper member.

FIGS. 5 and 6 are sectional views taken along the line A–A' and B–B', respectively, in FIG. 1 in which the plural floor panels 2 are connected and placed on a plurality of sleeper members 60, while catch basin portions 80 and 90 are set between every adjacent floor panels 2. That is, shown in FIG. 1 is a single the floor panel out of the plural floor panels 2 whereas FIGS. 5 and 6 each show the plural floor panels 2, which are supported by the plural sleeper members 60.

A cover member 70 that serves as the floor face and has a rectangular shape is placed over the main body portion 20 of the respective floor panels 2 sandwiching therebetween an elastic member 75 molded from silicon rubber or the like. Four sides of the cover member 70 serve as side walls 71 hanging from the floor surface, and cover the elastic member 75.

A reinforcing portion 27 having a triangular shape in section is provided at the center of the main body portion 20, in parallel with the side wall 22. The reinforcing portion 27 is formed by bending the center of the main body portion such that it protrudes downward.

In each of the floor panels 2 with this configuration, a member connecting to the main body portion 20, which excludes the cover member 70, is integrated with the main body portion 20. This may be formed by bending one sheet of metal (such as stainless steel plate), or by welding the two members. Alternatively, the main body portion 20 and the member integrated with the portion 20 may be obtained by filling a mold with a resin or the like.

In order to lay the floor panels 2, as shown in FIG. 5, the connecting portion 40 of one of the floor panels 2 is fit into the gutter portion 30 of another one of the floor panels 2 adjacent to the former panel. In other words, the height of the outer side wall 34 of the gutter portion 30 is substantially the same as the height of the connecting side wall 42 of the connecting portion 40, and the top of the outer side wall 34 abut the back of the second stepped portion 41 of the connecting portion 40. The height of the connecting side wall 42 may be shorter than that of the outer side wall 34. In this way, the floor panels 2 are connected one after another in the lateral direction.

To lay the floor panels 2 in the longitudinal direction, the floor panels 2 are placed on the plural sleeper members 60 that have previously been installed with given intervals, which correspond to the width in the longitudinal direction of the respective floor panels 2. That is, as shown in FIG. 6, each of the sleeper members 60 has fixed thereon an end of one of the floor panels 2 and an end of another one of the floor panels 2 adjacent thereto, the ends facing each other.

Each of the sleeper members 60 is formed from a hollow steel material having an opening on its center top, and is composed of a bottom 61, side walls 62, 62 standing upright on the bottom 61, and slant tops 63, 63 inclined downward from upper portions of the side walls 62, 62. The slant tops 63, 63 have the same inclination as that of the second slant portion 24. The width on the back side of the second slant portion 24 and the width on the upper side of each slant top 63 are substantially the same. Therefore, the shorter sides of the respective floor panels 2 in FIG. 6 are positioned to the left and to the right of the upper portion of each of the sleeper members 60, respectively, and are fixed thereon.

A bolt 12 pierces through the first slant portion 23 and the second slant portion 24 of the respective floor panels 2, and the slant top 63 of the respective sleep members 60 to thereby firmly fix the respective floor panels 2 to the respective sleep members 60. The first slant portion 23, the second slant portion 24, and the slant top 63 which are fixed by the same bolt 12 are inclined in the same direction, making it easy to set or remove the bolt 12.

Figure 7:
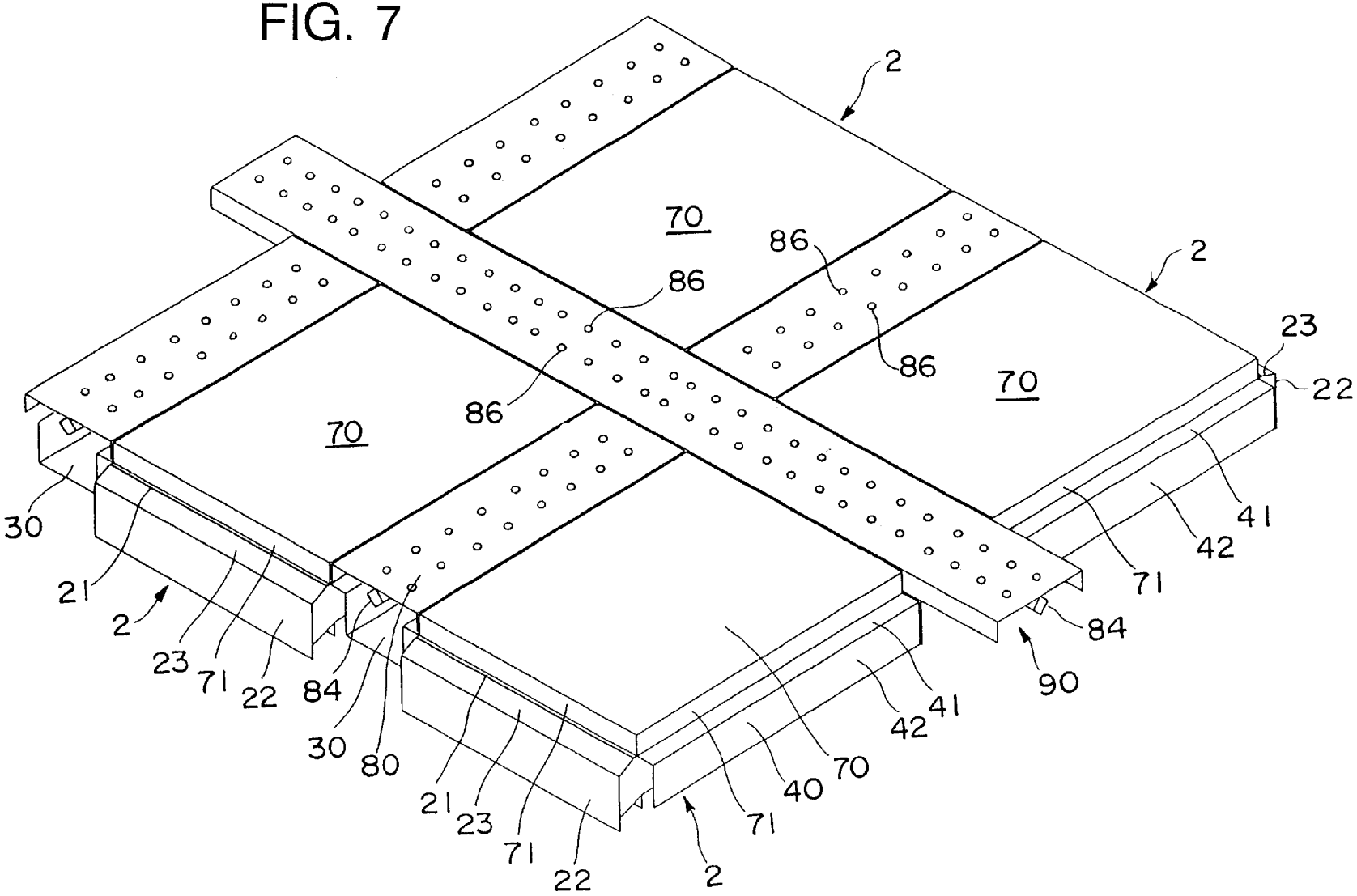
FIG. 7 is a perspective view showing four floor panels combined in accordance with the embodiment.

Now, FIG. 7 shows four floor panels 2 combined together. The catch basin portion is arranged between every adjacent floor panels 2. In other words, the catch basin portion 80 is set in a first opening (previously mentioned as opening) 16 above the gutter portion 30 while the catch basin portion 90 is set in a second opening (previously mentioned as second opening) 14 above and perpendicular to the gutter portion 30.

The catch basin portions 80 and 90 are, as shown in FIGS. 5 and 6, each provided with a top plate portion 81 and leg portions 82, 82 that are formed on both widthwise edges of the top plate portion 81. The center of the top plate portion 81 has on its back side a conduit tube 84 inside which a channel 85 is formed. The channel 85 communicates with a pair of sprinkling holes 86, 86 extending straight from the upper portion of the conduit tube 84 to the surface of the top plate portion 81. Multiple pairs of sprinkling holes 86, 86 are formed axially with respect to the catch basin portions 80 and 90. Each pair of sprinkling holes 86, 86 are formed outward (toward the floor panels 2) at an angle of roughly 45° C. with respect to the horizontal direction. The front sides of the catch basin portions 80 and 90 communicate with the first opening 16 and the second opening 14, which are below the catch basin portions 80 and 90, respectively, through a large number of communication holes (not shown).

Figure 8:
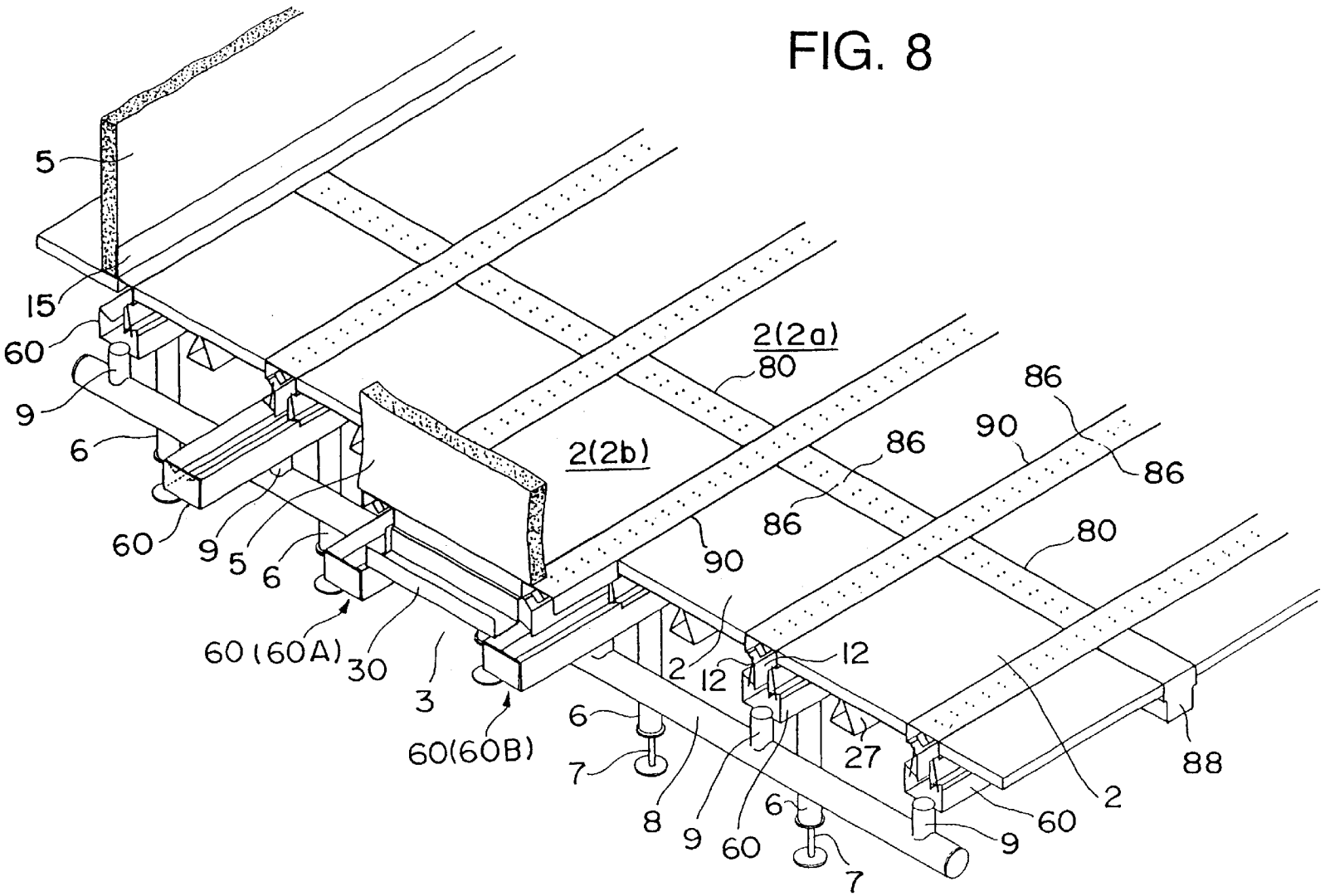
FIG. 8 is a perspective view showing the flooring for a building constructed in accordance with the embodiment.

Upon construction of the flooring for a building according to this embodiment, as shown in FIG. 8, a plurality of sleeper members 60 are arranged in parallel in accordance with the width of the respective floor panels 2. Each of the sleeper members 60 is supported by a strut member 6 on a floor slab 3. An adjuster 7 is provided on the bottom of the strut member 6, making it possible to adjust the height of the strut member. In FIG. 8, sleeper members 60A and 60B each illustrate a complete sleep member, and a floor panel 2*b* represents a complete floor panel. However, in order to facilitate understanding of the flooring structure, some of the sleeping members and a part of the flooring panel are cut off in FIG. 8.

One of the floor panels 2 is placed flush against a wall 5, striding over two adjacent sleeper members 60, and then the floor panels 2 are laid one after another in a single file in the longitudinal direction. Each of the floor panels 2 is fixed to the sleeper members 60 by the bolt 12. Continuous laying of the floor panels 2 in the lateral direction (the axial direction of the sleep members 60) is achieved by repeating connecting the gutter portion 30 of one of the floor panels 2 to the connecting portion 40 of another one of the floor panels 2 laterally-adjacent thereto (corresponding to the relation between the floor panel 2*b* and a floor panel 2*a*) and then fixing both the floor panels 2 with the bolts 12, 12. Positioning of the floor panels 2 can be accurately made through a simple work where all that is required is to fit the connecting portion 40 of the floor panel to be laid next into the gutter portion 30 of the already installed floor panel.

A horizontal drain pipe 8 is provided near one ends of the assembled sleep members 60 such that the pipe is perpendicular to the sleep member. The horizontal drain pipe 8 communicates with the inside (flow path) 64 of the respective sleep members 60 through a vertical drain pipe 9. A sealing portion 88 is attached to the gutter portion 30 on every edge of the whole floor. A shield 15 is applied to the vicinity of each boundary between the floor and the wall 5 so that the splashed washing water does not soil the wall 5.

Next, the operation in washing the flooring will be described.

When a caretaker operates a not-shown control panel, a feed valve connected to the terminal of the conduit tube 84 is opened to feed washing water into the channel 85. The washing water in the channel 85 is sprinkled from the sprinkling holes 86, 86 on the top of the floor panels 2 (the surface of the cover member 70)

The washing water used to wash the top of the floor panels 2 drips downward through the communication holes formed in the catch basin portions 80 and 90, or through gaps between the catch basin portions 80 and 90 and the floor panels 2, respectively. The washing water dripping from the catch basin portion 80 is received by the gutter portion 30, and runs through the gutter portion 30 and the terminal thereof down to one of the sleep members 60. The washing water dripping from the catch basin portion 90 is directly received by one of the sleep members 60. Then, the washing water in the respective sleep members 60 flows into the horizontal drain pipe 8 through the vertical drain pipe 9, and is drained into a major drain pipe.

The description given next deals with a repairing process in case of breakage of the flooring, or on other similar occasions.

The damage most often given to the floor panels 2 after the completion of construction is superficial damage. In that case, repair is done by simply replacing the cover member 70. If the entire removal of the floor panels are need, since each of the floor panels 2 can readily be replaced, repair is easily carried out as follows: the floor panels 2 are removed in order starting from the one situated on the extreme end in the direction of the gutter portion 30, panels that need repairs are replaced with new floor panels 2, and then undamaged panels among the removed floor panels 2 are returned one after another.

As described above, according to the flooring for a building of this embodiment, the need for a conventional joist member is eliminated and the thickness of the flooring as a whole can be thinned accordingly.

The gutter portion 30 and the connecting portion 40 are integrated with the respective floor panels 2, making it possible to reduce the number of parts as well as to simplify the operation of connecting the floor panels. Moreover, the gutter portion 30 of the respective floor panels 2 can establish communication between its terminal and the opening of the respective sleeper members 60 while simply being suspended over the sleeper members 60, promoting an easy construction.

Figure 9:
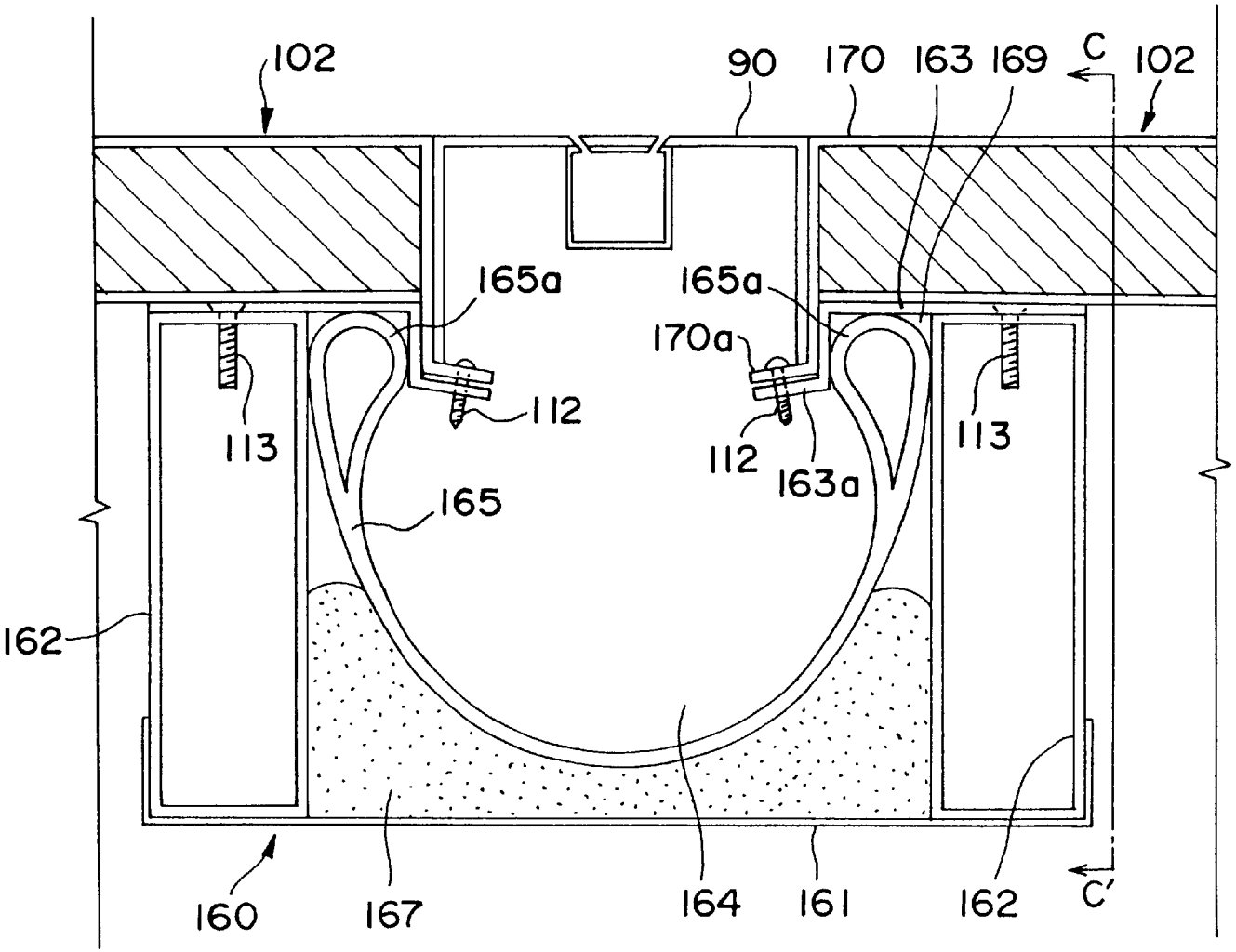
FIG. 9 is a sectional view showing another mode of the sleeper member cut along the line D–D' in FIG. 10.
Figure 10:
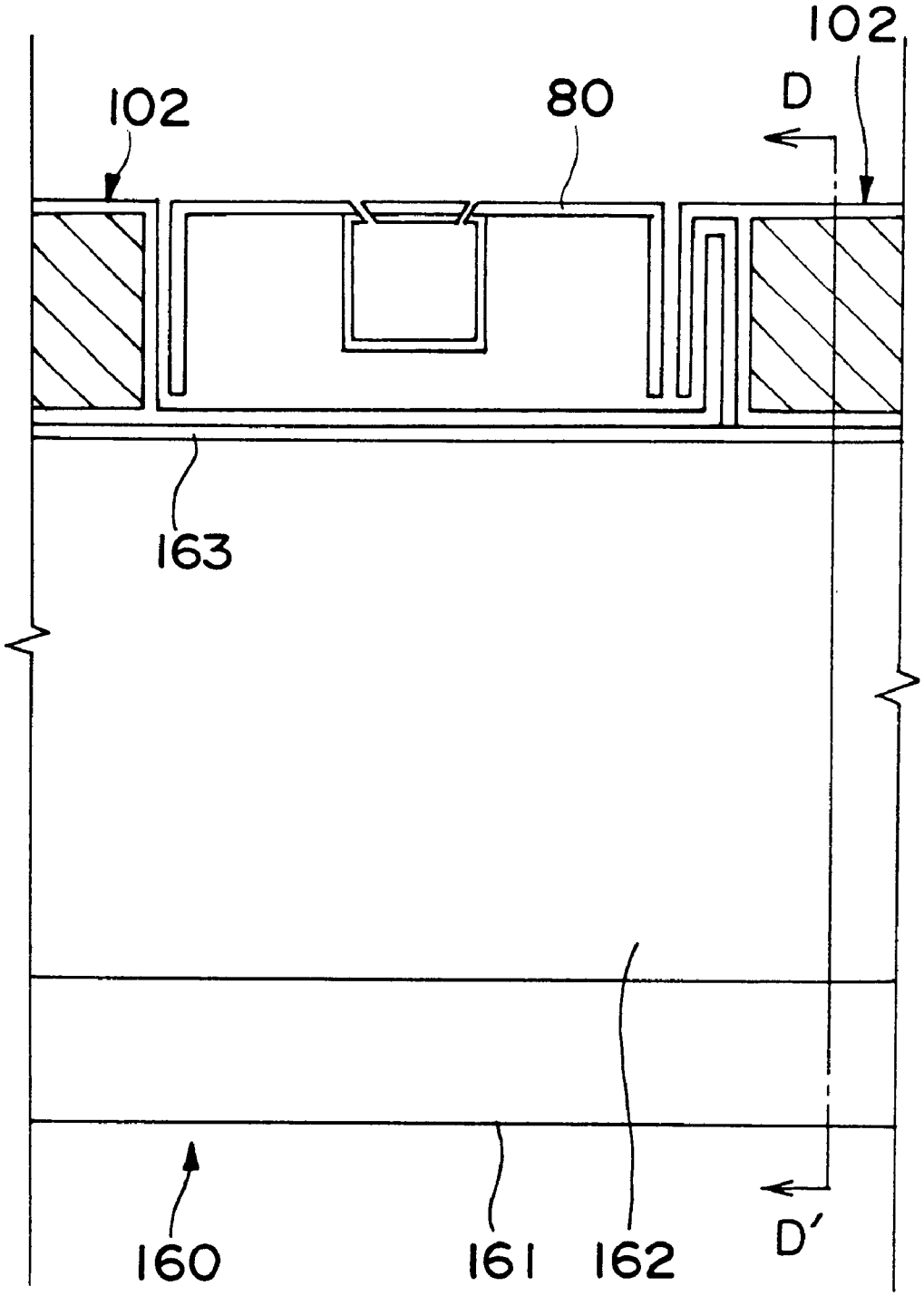
FIG. 10 is a sectional view showing the floor panel cut along the line C–C' in FIG. 9.
Figure 11:
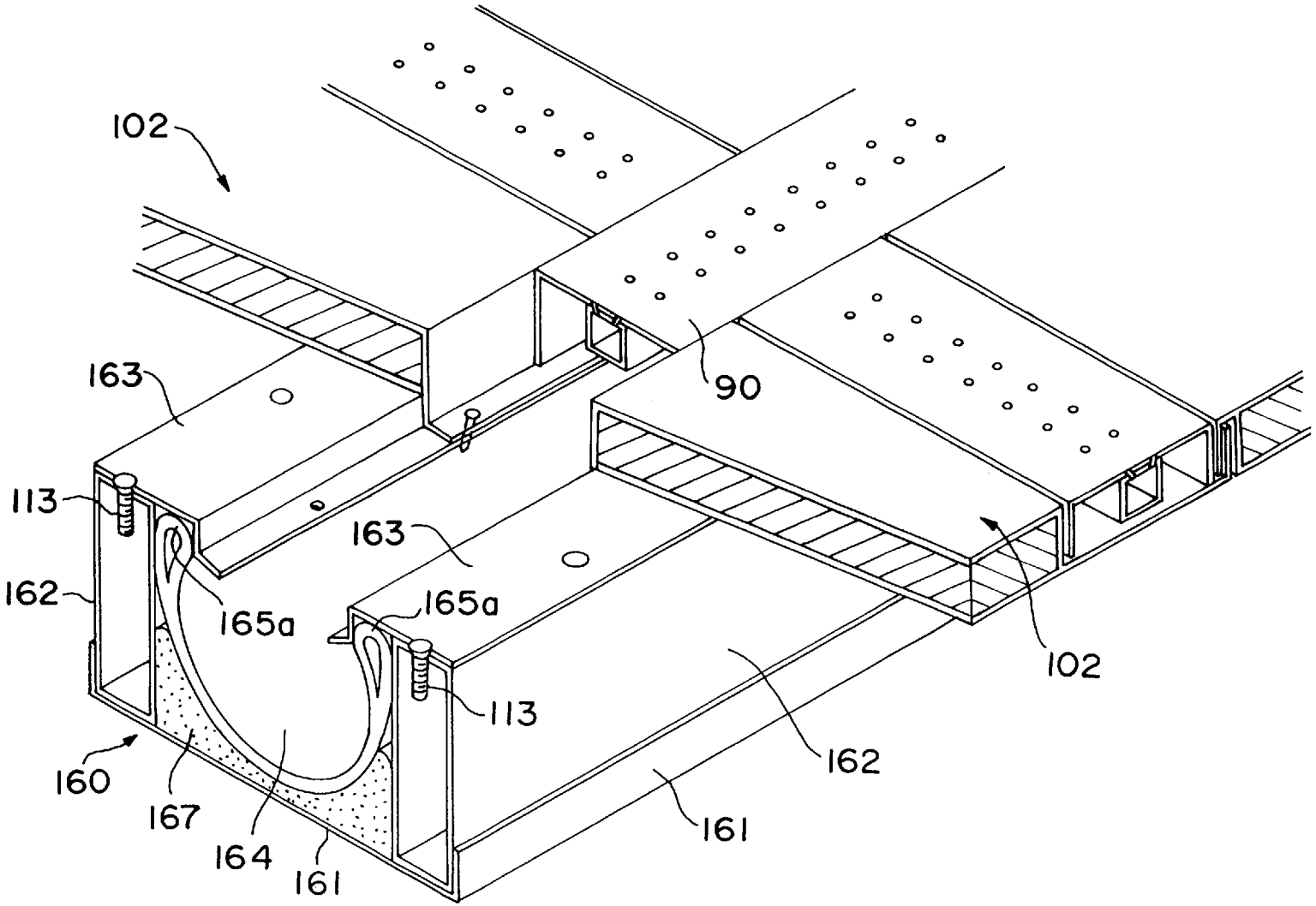
FIG. 11 is a perspective view showing the flooring for a building according to the embodiment of the present invention.

The structure of and around the sleeper member may be as shown in FIGS. 9 to 11. To elaborate, the sleeper member may be composed of separate members, one of which is a member for receiving the load of the floor panel and the other of which serves as a drainage path.

A pair of support members 162, 162 formed from hollow beams (steel) to support a floor panel 102 are integrated with a bottom plate 161 by welding. An upper support member 163 is provided between the floor panel 102 and the supporting member 162. The upper support member 163 is bent downward at its ends, forming stepped portions 163*a*, 163*a*. A cover portion 170 of the floor panel 102 is also bent downward to form, above the stepped portion 163*a*, a stepped portion 170*a* that has the same shape as the stepped portion 163*a*.

The upper support member 163 and the supporting member 162 are fixed to each other with a bolt 113. The upper support member 163 (the stepped portion 163*a*) is fixed to the cover member 170 (the stepped portion 170*a*) using a bolt 112.

An alcove 169 is formed between the supporting member 162 and the stepped portion 163*a*.

Above the bottom plate 161, a semicylindrical drainage path portion 165 made of polyethylene is arranged with a mortar layer 167 therebetween. Upper ends 165*a*, 165*a* of this drainage path portion 165 are swelled out, maintaining their elasticity, and are fitted into the alcoves 169, 169.

In the drainage path portion 165, a flow path 164 directly receives waste water dripping from the catch basin portion 90 between adjacent two floor panels 102, 102.

In a sleeper member 160, the drainage path is formed from a synthetic resin member. The drainage path portion 165 is thus formed separately from members for receiving the load (162 and other members), which require a solid structure. This makes unnecessary the use of an expensive material such as stainless steel for the sleeper member 160, reducing the cost of constructing the flooring on the whole. Moreover, it is easy to replace only the drainage path portion 165, which has more chances to be soiled than other parts of the sleeper member 160.

The present invention is not limited to the contents of the embodiment described above, but is adaptable to various modifications by those skilled in the art without departing from the spirit of the present invention defined by the scope of patent claims attached hereto.

What is claimed is:

1. Flooring for a building, which has a plurality of floor panels laid in parallel to constitute a whole floor, comprising:

an opening formed on a floor surface between one floor panel and its adjacent floor panel, and a gutter portion that is arranged below said opening to receive a liquid dripping from said opening, wherein said gutter portion is formed as an integral part of said one floor panel, and communicates with a drain pipe for draining the liquid in said gutter portion to the outside, wherein each of said floor panels has said gutter portion on one side and, on the other side, a connecting portion for connecting the gutter portion of another floor panel, and wherein said floor panels having the same shape are arranged such that said gutter portion of one floor panel is connected to said connecting portion of another floor panel, whereby said plural floor panels paralleled in the lateral direction constitute the whole floor.

2. Flooring for a building as claimed in claim 1, wherein:

each of said floor panels is formed into a rectangular shape in plane;

a plurality of sleeper members each having a flow path open to above and supporting said floor panel are provided beneath the whole floor; and each of said sleeper members is substantially perpendicular to said gutter portion at a vertical position below said gutter portion, and said gutter portion communicates with said flow path of said sleeper member to flow the liquid in said gutter portion into said flow path.

3. Flooring for a building as claimed in claim 2, wherein:

a second opening is formed on a floor surface between one floor panel and its longitudinally-adjacent floor panel;

said sleeper member is arranged under said second opening; and said flow path in said sleeper member directly receives a liquid dripping from said second opening.

4. Flooring for a building as claimed in claim 2, wherein said flow path in said sleeper member is formed of a synthetic resin material.

* * * * *